United States Patent [19]

Ogura

[11] 4,022,252

[45] May 10, 1977

[54] HEDDLE FRAME FOR A HIGH SPEED WEAVING MACHINE

[75] Inventor: Hiroshi Ogura, Sakai, Japan

[73] Assignee: Maruyama Seisakusho Kabushiki Kaisha, Osaka, Japan

[22] Filed: Feb. 5, 1976

[21] Appl. No.: 655,461

[52] U.S. Cl. ..... 139/91; 139/82
[51] Int. Cl.[2] ..... D03C 9/06
[58] Field of Search ..... 139/91.92, 82

[56] References Cited

UNITED STATES PATENTS

| | | | |
|---|---|---|---|
| 2,510,404 | 6/1950 | Lake et al. | 139/82 |
| 2,981,293 | 4/1961 | Nussbaum | 139/91 |
| 3,020,930 | 2/1962 | Pfarrwaller | 139/82 |
| 3,088,496 | 5/1963 | Houghton et al. | 139/92 |
| 3,796,235 | 3/1974 | Muller | 139/82 X |

FOREIGN PATENTS OR APPLICATIONS

| | | | |
|---|---|---|---|
| 225,635 | 1/1963 | Austria | 139/82 |
| 404,580 | 7/1966 | Switzerland | 139/91 |
| 925,562 | 5/1963 | United Kingdom | 139/91 |

*Primary Examiner*—James Kee Chi
*Attorney, Agent, or Firm*—Oblon, Fisher, Spivak, McClelland & Maier

[57] ABSTRACT

A heald or heddle frame for a high speed weaving machine comprises a side stay having a core made of metal, one portion of which is free to slide in a guiding groove of a device for guiding the heddle frame and the other portion of which is covered with plastic to provide additional strength, a pair of joining pieces projecting from the strengthened portion of the core of the side stay as one body and forming a tapered groove therebetween, a hollow cross beam of metal for receiving said joining pieces, and wedge means for pressing said joining pieces outwards being mounted in the tapered groove of the joining pieces.

7 Claims, 7 Drawing Figures

FIG. 1A PRIOR ART
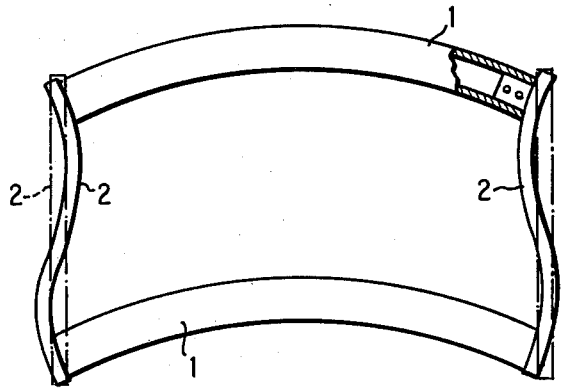
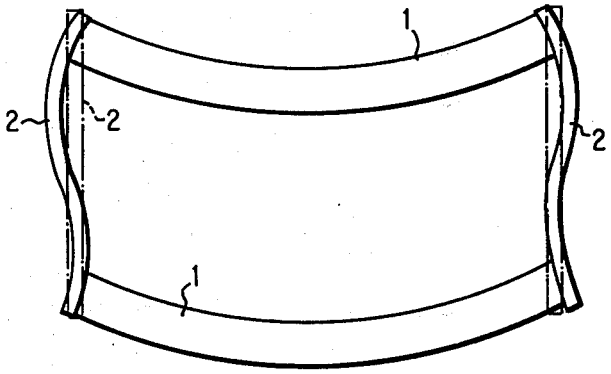
FIG. 1B PRIOR ART
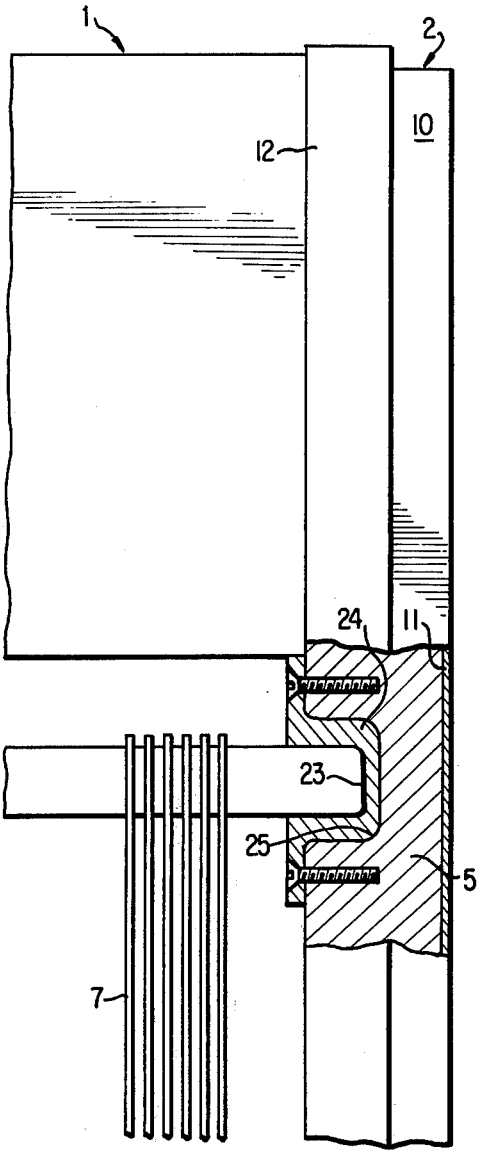
FIG. 6

HEDDLE FRAME FOR A HIGH SPEED WEAVING MACHINE

BACKGROUND OF THE INVENTION

1. Field of the Invention

The present invention relates generally to high speed weaving machines and more particularly to an improved heald or heddle frame for a high speed weaving machine.

2. Description of the Prior Art

A heddle frame used in a weaving machine conventionally is composed of a pair of side stays 2, 2 and a pair of cross beams 1, 1 as shown in FIGS. 1A and 1B wherein the bending state in a shedding motion of an ordinary heddle frame is illustrated. The side stay portion of the heddle frame is free to slide in a guiding groove formed in a guiding apparatus to make a shedding motion. With respect to a high speed weaving machine, which makes a shedding motion with rotation of 300–600 rpm, a joining device is very complex and heavy in weight, so as to strengthen the joint between a side stay and a cross beam, and, as the shedding motion of a heddle frame is very high in speed the inertia of the heddle frame, owing to the weight thereof, is very large. Accordingly, breaking of the heddle frame thus occurs readily to reduce the life thereof. Other defects of the conventional heddle are that they wear quickly and they generate substantial noise.

To overcome such defects, a hollow cross beam made of aluminum has been used to make a heddle frame which is light in weight and to make the inertia of the weight of the heddle frame small. However, the bending of the pair of cross beams 1, 1 during a shedding motion cannot be prevented. That is to say, according to shedding motion, the phenomenon that a pair of cross beams 1, 1 bend as shown in FIG. 1A and FIG. 1B arises. During this phenomenon, since the strength of the pair of side stays 2, 2 is greater than that of the pair of cross beams 1, 1, the side stays 2, 2 cannot bend, respectively, as shown by the dotted lines in FIG. 1A and FIG. 1B. Therefore, the largest moment is applied to the joining portion of the side stays and the cross-beams and the joining portion is thus cut or broken. When a bolt is used for joining the side stay and the cross beam, such problems as cutting of the bolt or loosening of the bolt and a respective nut occur. Most of the breaks of ordinary heddle frames are due to cutting of the joint material or cutting of the joining portion.

SUMMARY OF THE INVENTION

Accordingly, it is an object of the present invention to provide an improved heald or heddle frame having a simplified joining construction between a cross beam and a side stay, and being light in weight.

Another object of the present invention is to provide an improved heddle frame having resistance to cutting and breaking of the joining portion thereof, as caused by the bend being prevented, and which generates little noise.

Another object of the present invention is to provide a heddle frame having an easily joined cross beam and side stay, in which a heddle is readily removed and mounted while heddling a vertical yarn, and which can be rapidly repaired when the side stay becomes worn or broken.

The foregoing and other objects are attained according to at least one aspect of the present invention through the provision of a heddle frame which comprises a side stay having a core made of metal, one portion of which is free to slide in a guiding groove of a device for guiding the heddle frame and the other portion of which is covered with plastic to provide additional strength, a pair of joining pieces projecting from the strengthened portion of the core of the side stay as one body and forming a tapered groove therebetween, a hollow cross beam of metal for receiving said joining pieces, and wedge means for pressing said joining pieces outwards being mounted in the tapered groove of the joining pieces.

BRIEF DESCRIPTION OF THE DRAWINGS

Other objects of the present invention will be more fully appreciated as the same becomes better understood from the following detailed description of the present invention, when considered in connection with the accompanying drawings, wherein like reference characters designate like or corresponding parts and in which:

FIGS. 1A and 1B are explanatory views, already described, showing the bending state occurring during a shedding motion of an ordinary heddle frame;

FIG. 6 shows a part of another embodiment of a heddle frame according to the present invention.

DETAILED DESCRIPTION OF THE PREFERRED EMBODIMENTS

Figure 2:
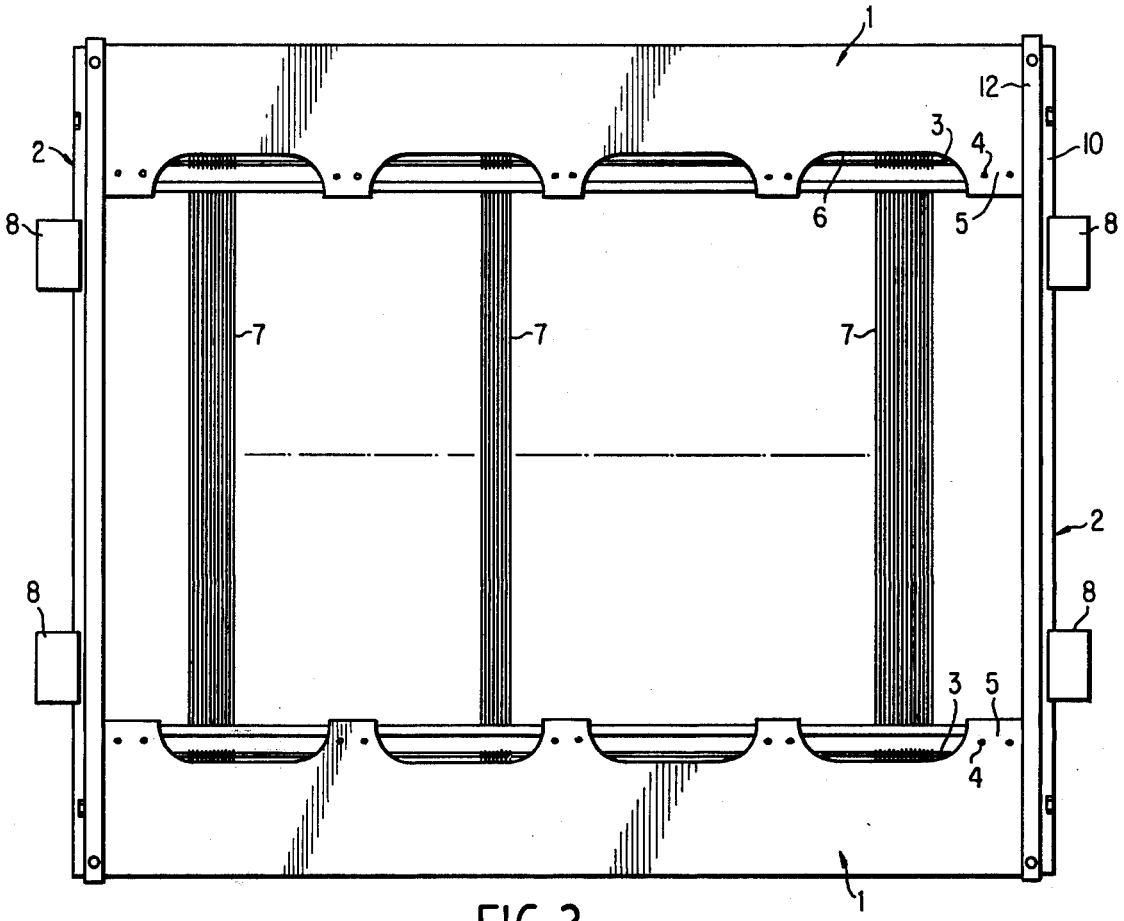
FIG. 2 is a front view of the heddle frame of a high speed weaving machine according to the present invention.

Referring now to FIG. 2 of the drawings, a heddle frame is shown being composed of a pair of cross beams 1, 1 and a pair of side stays 2, 2. The cross beams 1, 1 are formed, respectively, by an aluminum hollow body having a setting portion 5 projecting from the center side surface thereof. Connected to the setting portion 5 by rivets 4 is a heddle shaft 3. The setting portion 5 has cut-out portions 6 at several spaced positions thereof, so as to permit ready inspection of the setting state of a heddle 7 and further to make the cross beam light in weight.

Figure 5:
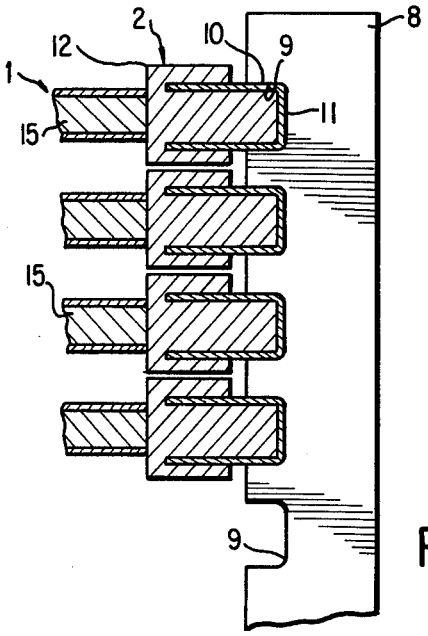
FIG. 5 is a sectional plan view showing the side stay of the heddle frame according to the present invention being free to slide in the guide groove of the guide means therefor.
Figure 3:
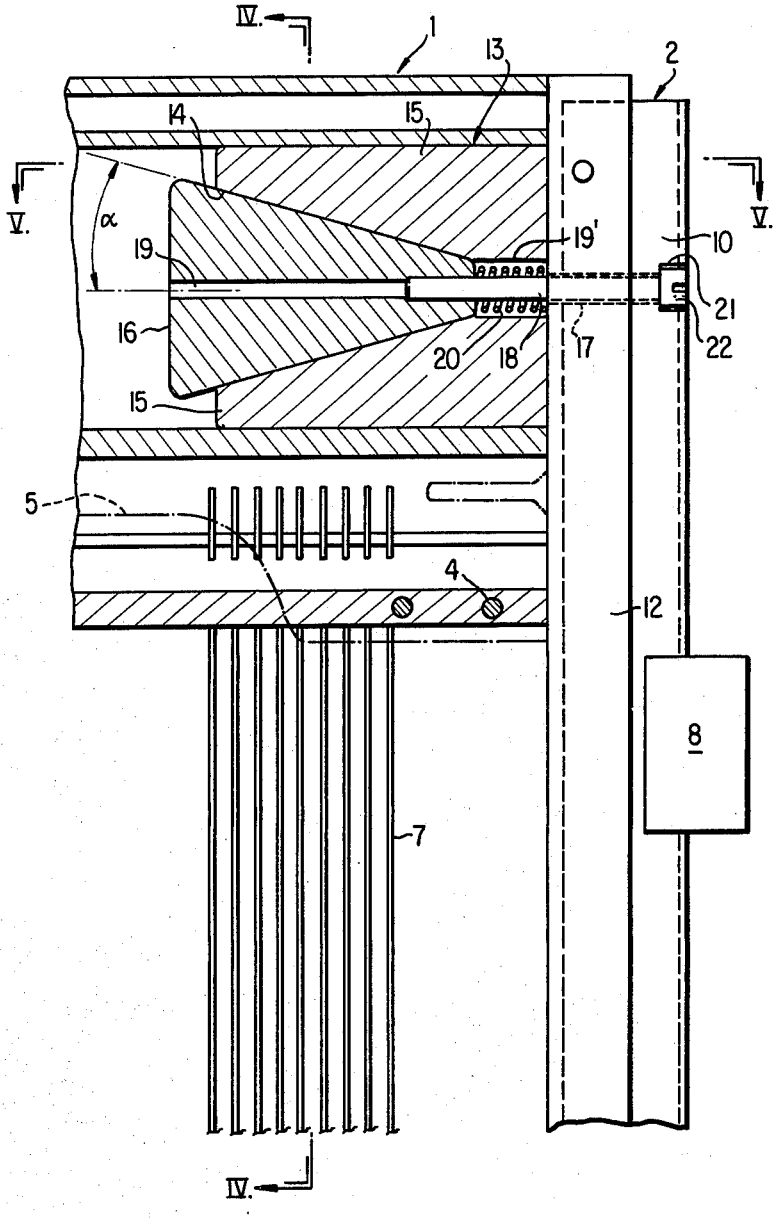
FIG. 3 is an enlarged front view with a section showing a part of the main portion of the heddle frame of the present invention.
Figure 4:
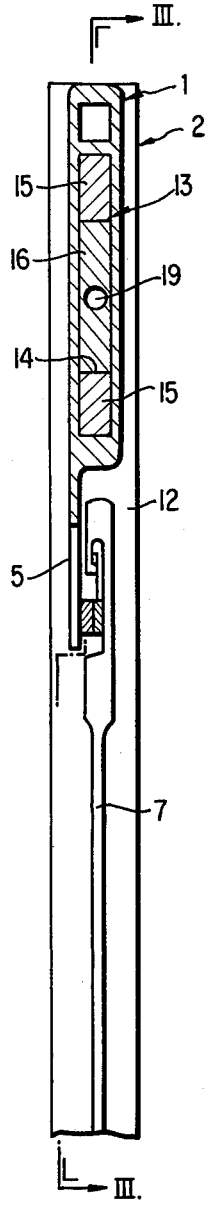
FIG. 4 is a sectional view taken along the line IV—IV of FIG. 3.

On the other hand, as shown in FIG. 5, the side stays 2, 2 each have a core 11 made of a U-shaped metal comprising a sliding portion 10 free to slide in a guiding groove 9 of a guiding means 8 for guiding the heddle frame. This core 11 is covered with a flexible plastic strengthening portion 12, such as a web state nylon resin, with respect to the inner and outer surface of the open side thereof, with the exception of the outer surface of the sliding portion 10. At the upper portion and the lower portion of this pair of side stays, the upper portion only being shown in FIG. 3, there is formed as one body a joining portion 13 made of synthetic resin for inserting into and joining the hollow cross beam. This joining portion 13 is composed of a pair of joining pieces 15, 15 forming a groove 14 having a tapered surface with a larger diameter at one end thereof and mounted at the center portion thereof. In the tapered groove 14, between both joining pieces 15, 15 there is inserted a wedge 16, both sides of which are tapered, and which is made of a synthetic resin, such as, for example, nylon or a formaldehyde polymer, or even a light metal. When the wedge 16 is made of synthetic resin, a regulating screw 18 penetrating through an opening 17 formed in the side stay 2 is screwed forcedly into an opening 19 formed in the wedge 16 and having a diameter smaller than that of the regulating screw 18. Thus, the wedge 16 is moved between both joining pieces 15, 15 to the side of the side stay 2 and both joining pieces 15, 15 are pressed outwards and are thus fixed tightly on the inner wall of the cross beam 1. As already indicated, the wedge 16 is made of light metal or synthetic resin, preferably nylon. When the wedge 16 is made of a synthetic resin, it is not necessary to tap the opening 19.

The regulating screw 18 has a coil spring 20 disposed thereabout, which constantly urges the wedge 16 toward the removing side of the pieces 15, 15. The angle $\alpha$ of the wedge 16 is preferably set from 13° to 30°, so that the wedge 16 can automatically be removed from the tapered groove 14, by means of the elastic force of the coil spring 20, when the regulating screw 18 is removed from the small end of the wedge 16.

The numeral 19' indicates an opening with a large diameter penetrating to the end of the wedge 16, in communication with the opening 19 thereof, and the numeral 21 denotes a cut-out portion formed in the sliding portion 10 for receiving the head portion 22 of the regulating screw 18.

Further, as shown in the embodiment of FIG. 6, with respect to a heddle frame for supporting a heddle rod in the form of a middle hook, in the side stay 2 there is formed a setting hole 25 for inserting and fixing a rod supporting means 24 having an inserting hole 23 of a heddle rod 3.

The preferred embodiment, according to the present invention, is composed as described above. Therefore, a cross beam 1 and a side stay 2 are joined only by screwing the regulating screw 18 from the side stay 2 into the wedge 16 in the cross beam 1 and, as the outer and inner surface of the core metal 11 and the joining pieces 15, 15 are made of synthetic resin, wear at the point of contact of one side stay with the other side stay during forward and backward motion at the opening motion of the heddle frame and noises at that time can be readily prevented.

Further, as the pair of side stays 2, 2 bend, respectively, as shown in FIG. 1 by real lines, when the pair of cross beams 1, 1 bend respectively, because of the elastic nature of the reinforced portion provided by the synthetic resin and the U-shaped metal core 11 thereof, abnormal load is not generated at the joining portion, and the breaking thereof is prevented, while at the same time, the whole weight of the heddle frame can be lightened.

Still further, as it is very simple to mount and remove the pair of side stays 2, 2 it is very simple to mount and remove the heddle 7 to the heddle shaft 3 by a machine and, at the same time, it is simple to change the pair of side stays 2, 2 when they become worn.

Moreover, it is very simple to remove the side stay 2 by automatically projecting the wedge 16 from the pieces 15, 15 by the force of the coil spring 20, as the tapered angle $\alpha$ of the wedge is set from 13° to 30°.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heddle frame of a high speed weaving machine comprising:

a side stay having a metallic core, one portion of said core being free to slide in a guiding groove of means for guiding the heddle frame and another portion of said core being covered with a flexible reinforcing material to provide additional strength;

a pair of integrally formed synthetic resin joining pieces projecting from the flexible, strengthened portion of said core of said side stay and forming a tapered groove therebetween;

a hollow metallic cross beam for receiving said synthetic resin projecting pair of joining pieces therein; and wedge means, for pressing said synthetic resin joining pieces outwardly, being mounted in the tapered groove formed by said pair of synthetic resin joining pieces.

2. The heddle frame as set forth in claim 1, wherein said side stay is bent to form a U-shaped section with respect to the metal core thereof, the bent portion thereof forming a sliding portion.

3. The heddle frame as set forth in claim 1, wherein said wedge means is made of metal and forms a setting female screw and further comprising a male screw threadedly secured into said female screw through said side stay.

4. The heddle frame as set forth in claim 1, wherein said wedge means is made of synthetic resin in which an opening is formed and is set by screwing forcedly a male screw with a larger diameter than that of said opening in said wedge into said opening.

5. The heddle frame as set forth in claim 1, wherein said wedge has at least one tapered surface with a taper angle from 13° to 30°.

6. The heddle frame as set forth in claim 1, further comprising means for urging said wedge means outward from said tapered groove.

7. The heddle frame as set forth in claim 6, wherein said urging means comprises a coil spring.

* * * * *